US005383749A

United States Patent [19]

Reisdorff et al.

[11] Patent Number: 5,383,749

[45] Date of Patent: Jan. 24, 1995

[54] METHODS OF REINFORCING UTILITY POLE STRUCTURES HAVING THEIR LOWER ENDS EMBEDDED IN THE GROUND, AND REINFORCEMENT CAGE STRUCTURE USEFUL FOR PRACTICING THE METHOD

[76] Inventors: Robert A. Reisdorff, 622 E. Hillcrest; Douglas L. Kotil, 104 S. St., both of Seward, Nebr. 68434

[21] Appl. No.: 104,676

[22] Filed: Aug. 10, 1993

Related U.S. Application Data

[63] Continuation-in-part of Ser. No. 3,622, Jan. 13, 1993, abandoned.

[51] Int. Cl.[6] ..... E02D 37/00; E02D 5/64

[52] U.S. Cl. ..... 405/232; 52/170; 405/231

[58] Field of Search ..... 405/231, 232, 216, 252, 405/247, 244, 229, 253; 52/514, 515, 98, 296; 414/23; 294/110.1, 21; 156/71, 98

[56] References Cited

U.S. PATENT DOCUMENTS

| | | | |
|---|---|---|---|
| 1,811,899 | 6/1931 | Spring | 52/170 |
| 2,893,778 | 7/1959 | Eckstein | 414/23 X |
| 2,897,553 | 8/1959 | Gorron | 405/216 X |
| 3,350,822 | 11/1967 | Nachazel . | |
| 3,390,951 | 7/1968 | Finger et al. | 405/216 X |
| 3,690,715 | 9/1972 | Vanlingen et al. | 294/110.1 X |
| 4,044,513 | 8/1977 | Deike . | |
| 4,096,673 | 6/1978 | Deike . | |
| 4,618,288 | 10/1986 | Daigle | 405/232 |
| 4,621,950 | 11/1986 | Kinnan | 405/232 X |
| 4,697,396 | 10/1987 | Knight . | |
| 4,697,649 | 10/1989 | Kinnan | 405/232 X |
| 4,802,317 | 2/1989 | Chandler . | |
| 4,892,601 | 1/1990 | Norwood | 405/216 X |
| 4,921,555 | 5/1990 | Skiff | 405/216 X |
| 5,031,370 | 7/1991 | Jewett . | |
| 5,043,033 | 8/1991 | Fyfe | 156/71 |

*Primary Examiner*—Dennis L. Taylor
*Attorney, Agent, or Firm*—Learman & McCulloch

[57] ABSTRACT

A method of and apparatus for reinforcing wooden utility poles, having lower ends embedded in the ground, with elongate cage parts having grippers at their lower ends. The grippers are swingably secured to the cage parts for movement from a first position in which the grippers are in vertical alignment with the cage parts and can be driven into the earth to positions alongside the pole in which the grippers are beneath any weakened portions of the pole and can be swung to substantially grip the pole. The steps include forcing the cage portions down along the pole and then lifting the cage portions and thereby causing the pressure of the earth to swing the grippers to second position. The cage portions are secured to the pole above ground to form a unitary cage structure embracing the pole.

32 Claims, 5 Drawing Sheets

10
10a
18
19
21
22
23
26
28
29
30
31
32
33
C

METHODS OF REINFORCING UTILITY POLE STRUCTURES HAVING THEIR LOWER ENDS EMBEDDED IN THE GROUND, AND REINFORCEMENT CAGE STRUCTURE USEFUL FOR PRACTICING THE METHOD

The present application is a continuation-in-part of application Ser. No. 003,622 filed Jan. 13, 1993, now abandoned.

BACKGROUND OF THE INVENTION

After some years in service, wood utility poles such as power transmission poles, telephone poles, light poles and the like, tend to be subject to rotting just above and below ground level. While the pole is normally rotted in only a relatively small region, and perhaps the penetration of rot is limited, the pole is structurally weakened and may not be sufficiently strong to any longer resist the forces which are applied to it, which create bending stresses and other forces at ground line. This is particularly true with poles which are connected together in what are known as H-frame structures, and in guyed angle structures, wherein wind forces create an uplift force on one of the poles and a thrust force on the other. Because the pole may be in sound condition above and below the relatively short length rotted region, the reinforcement system to be disclosed can be applied to overcome the higher costs associated with replacing the pole in its entirety.

FIELD OF THE INVENTION

The present invention is concerned with a metal reinforcing system for such utility poles, and like poles and structures, which aids the pole to both resist bending stress and in resisting uplift and thrust forces.

SUMMARY OF THE INVENTION

The invention to be described provides a method of and device for gripping the pole both above and below the rotted region, to, in effect, splint the pole. In the method to be described, elongate metal cage parts, having grippers swingably connected at their lower ends, are driven down on opposite sides of the pole to be reinforced. When the cage parts are then lifted to a predetermined degree, the grippers are forced, by the earth encountered, toward the pole to grip it at its lower end. Thereafter, the cage parts are united at their upper ends to provide a unitary cage which embraces and fixes to the pole.

One of the prime objects of the invention is to provide a unique method of securing a ground line-bridging metallic cage structure to a utility pole or the like wherein, after driving one or more cage parts into position, grippers on the lower ends of the cage parts are moved in to the pole to grip it from opposing directions by the simple expedient of lifting the cage parts.

Another object of the invention is to provide a cage structure which is particularly adapted to reinforcing utility poles which are disposed in H-frame or guyed angle structures to resist uplift and thrust forces, as well as bending forces, in a positive manner, by enlisting the resistance of the ground to oppose the uplifting and thrust loads.

Another object of the invention is to provide a reinforcement method and system which can add twenty years of additional life to existing pole structures, and so aids tree conservation efforts.

Still another object of the invention is to provide a method and system of the character described which permits installation of the reinforcing cage structure without the interruption of electrical power.

Still another object of the invention is to provide a method and device of the character described which permits relatively rapid installation of the reinforcing structure with available equipment in virtually all soil conditions, including rather poor soil conditions, to provide adequate pole stability.

Other objects and advantages of the invention will become apparent with reference to the accompanying drawings and the accompanying descriptive matter.

IN THE DRAWINGS

Figure 13:
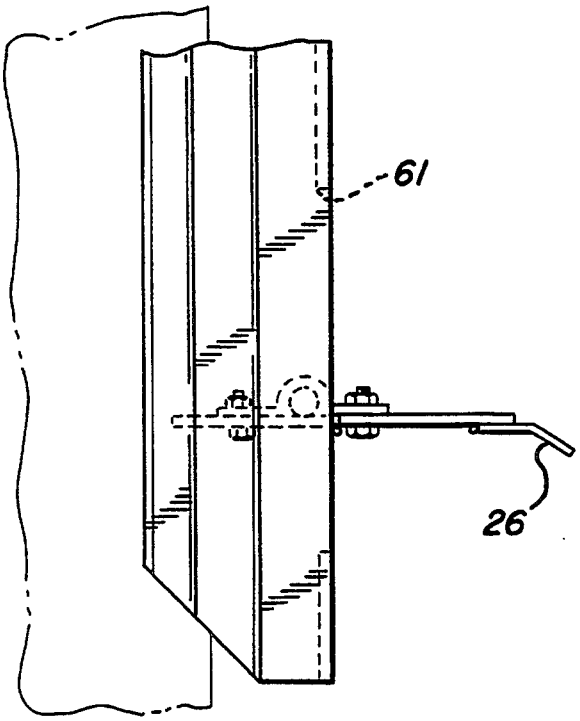

FIG. 13 a similar view, with the gripper shown in raised position.

THE DESCRIPTION

Figure 1:
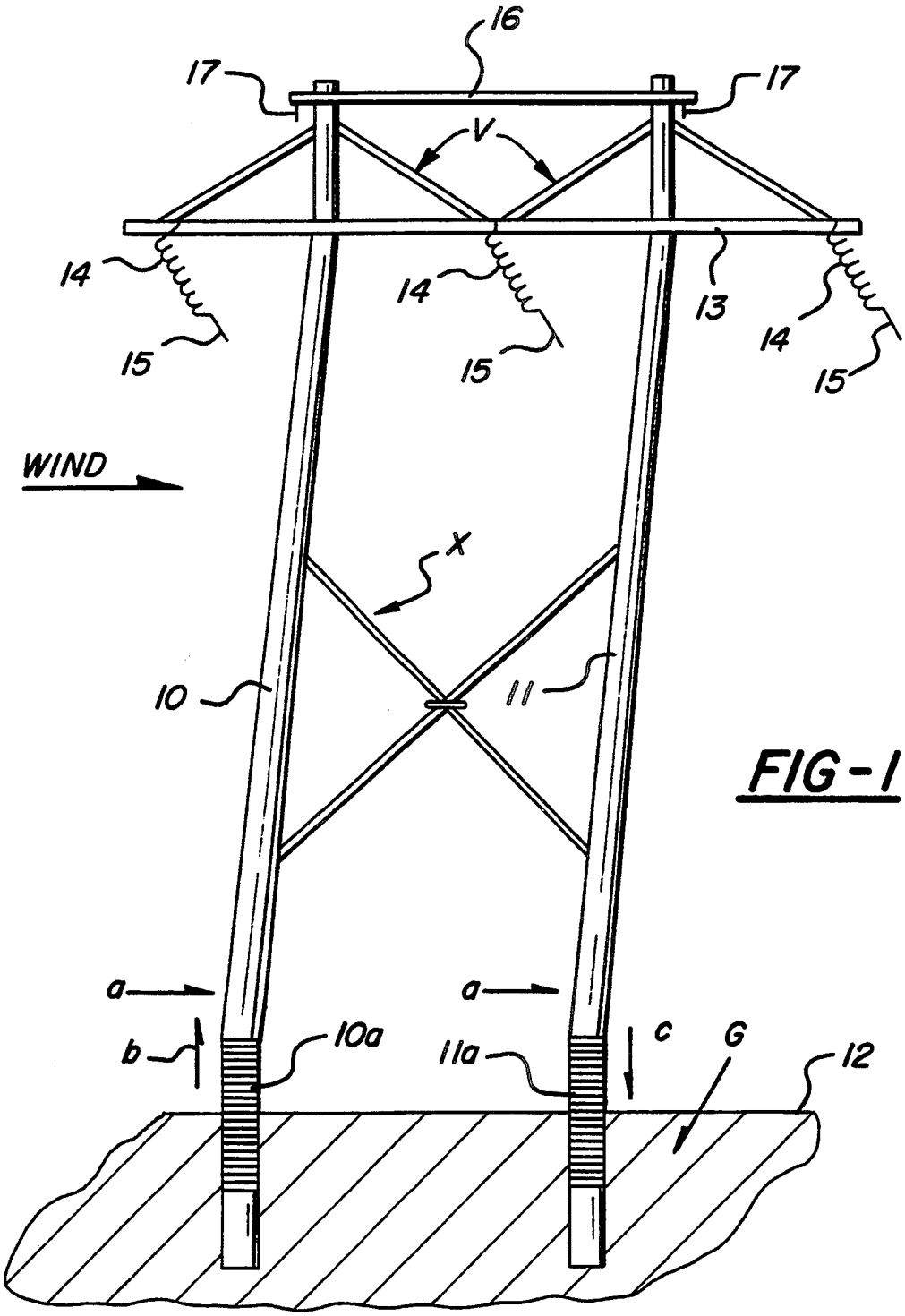
FIG. 1 is a side elevational view of a utility pole H-frame structure subjected to extreme wind forces to illustrate the imposition of consequent loads on the structure.

Referring now more particularly to the accompanying drawings and, in the first instance, to FIG. 1, wherein there is a representation of a typical H-frame power transmission structure subjected to extreme wind stress to illustrate the forces which are imposed on the structure, the numerals 10 and 11 identify a pair of spaced apart wooden poles having their lower ends embedded in the ground G. The shaded portions of the poles, at 10*a* and 11*a*, indicate areas of rotting above and below ground level, which is indicated by the numeral 12. The usual X-brace, generally designated X, is shown as employed between the poles 10 and 11 to connect them. They are also connected by an upper crossbar 13 which is braced by V-braces, generally designated V. Insulators 14 are provided for the three phase wires 15 which are supported by the crossbar 13, and wire support shield 16 also connects the upper ends of poles 10 and 11, and provides a connection for ground wires 17.

Figures 3, 4, 5:
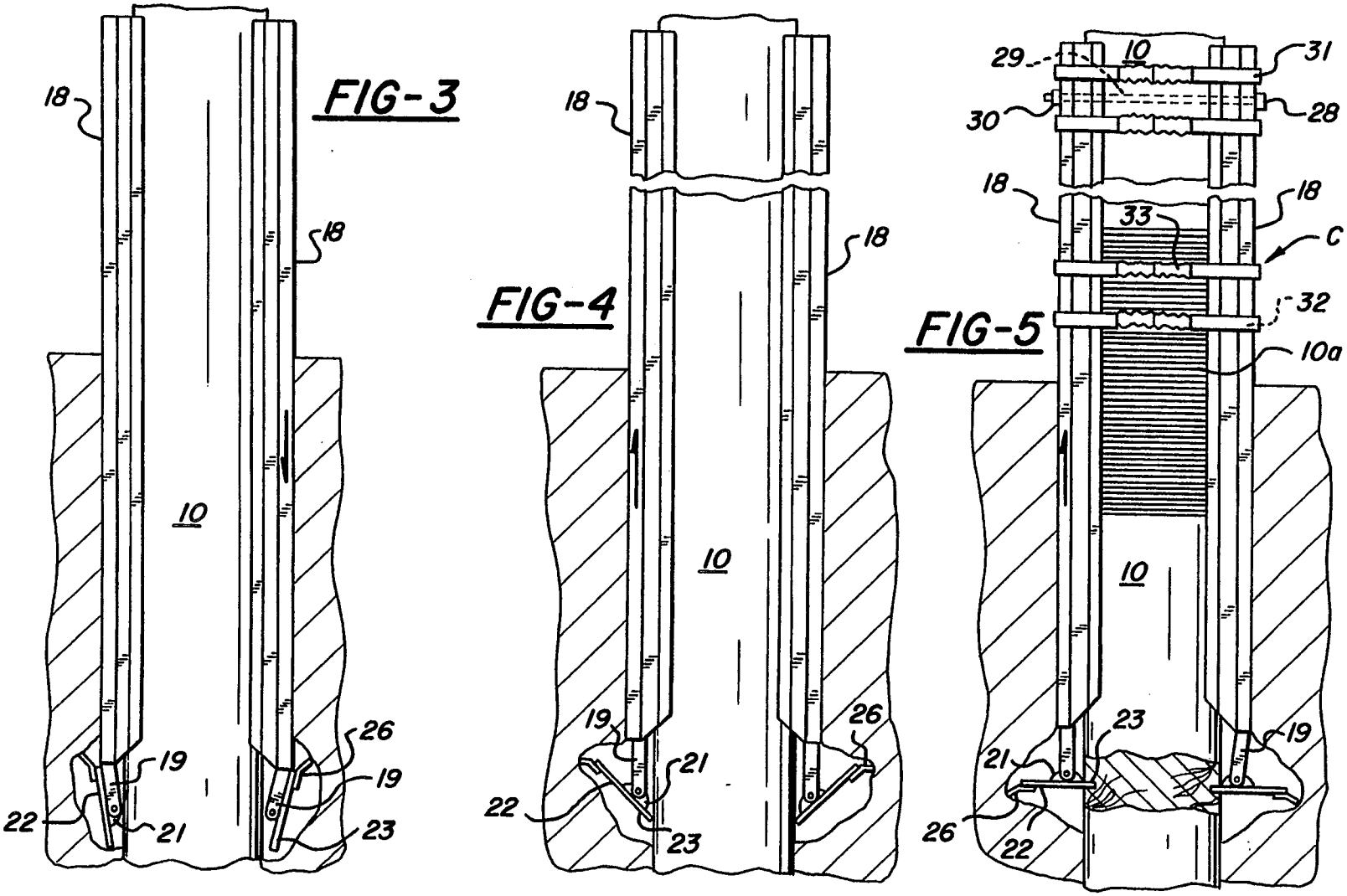
FIG. 3 is an enlarged, fragmentary, side elevational view showing both cage parts driven down into position.
FIG. 4 is a similar view with the cage portions shown being lifted to swing the grippers on their lower ends into gripping relationship with the pole.
FIG. 5 is a similar view in which the grippers are shown as swung further to penetrate the pole, and the cage structures are shown as mechanically secured to the pole at their upper ends as well, to form a unitary cage structure.

With the wind blowing in the direction indicated, bending stresses are exerted on the poles 10 and 11 as indicated by the arrows a. In addition, there is an uplift force b applied to pole 10 and a downwardly directed force c applied to pole 11. To reinforce the poles 10 and 11 shown in FIG. 1, or to reinforce any such pole singly, a unitary cage structure, generally designated C, is applied to the lower end of each of the poles to be reinforced, as shown in FIG. 5. Each of the cage structures C includes a pair of substantially 180° oppositely disposed, vertically elongate cage parts or elements, generally designated 18, which, after being driven down into position alongside the pole in a manner which will be described, are capable of gripping the pole 10 shown in FIG. 5 below the rotted area 10*a*.

Figures 6, 7, 8, 9, 10:
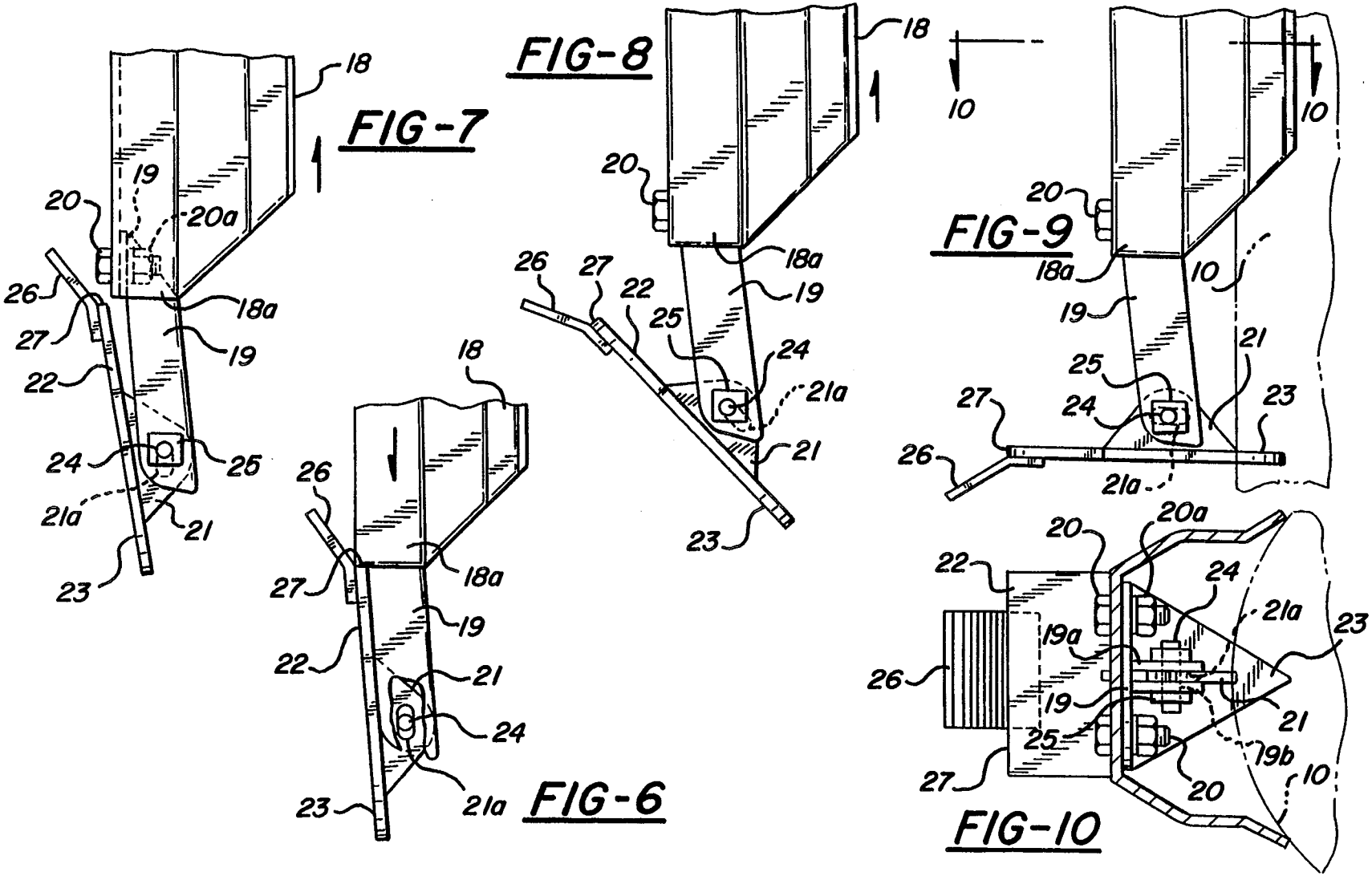
FIG. 6 is a still more enlarged, fragmentary, side elevational view, particularly illustrating the position of the gripper member when the cage portion is being driven down.
FIG. 7 shows an initially pivoted position of one of the grippers.
FIG. 8 shows a further pivoted position of one of the gripper members.
FIG. 9 shows a final pivoted position of the gripper.
FIG. 10 is a cross sectional view taken on the line 10—10 of FIG. 9.

As FIG. 10 particularly indicates, each cage portion 18 includes a vertically elongate channel member 18*a*, to the lower end of which is secured a clevis plate 19 mounting protrudent clevis elements 19*a*. Bolts and nuts, 20 and 20*a*, respectively, can be used to secure the plate 19 rigidly in position. Extending between the clevis plates 19*a*, is a bearing plate element 21, fixed to a gripper plate 22 having a convergent front end 23 configured to readily enter the ground and slice a path downwardly through the ground, as it is driven, in a manner which will be more particularly described. The clevis plate elements 19*a* have openings 19*b* for snugly admitting a pivot bolt 24, secured by a nut 25 in a manner such that the plate 21 is movable relative to bolt 24 within the confines of a slot 21*a* provided in element 21. Secured to the end of plate 22 opposite the V-shaped end 23 is a cam plate 26 which angles upwardly and outwardly when the gripper plate 22 is disposed in the FIG. 6 position. While the configuration for the front end of plate 22 is disclosed as V-shaped, it clearly could be double V-shaped in configuration, or of another configuration which facilitates driving of the portion 18 into position. When the gripper plate 22 is in driving position, its upper edge 27 is disposed directly beneath the lower ends of cage portion 18*a* and support plate 19, as shown in FIG. 6, so that driving force imparted to the cage part 18*a* is imparted directly to surface 27, rather than to bolt 24, which may be disposed midway, or so, in slot 21*a*.

When a lifting force is applied to cage portion 18*a* to move it upwardly, clevis parts 19*a* move upwardly relative to gripper 22 and its bearing plate 21 to dispose pivot bolt 24 in the upper end of slot 21*a*. The pressure of the earth on cam plate 26 first causes the surface 27 of gripper plate 22 to swing out from under cage part 18*a* as illustrated in FIG. 7 and then causes the gripper plate 22 to swing through the positions shown in FIGS. 8 and 9. While in FIG. 9, the end 23 is shown as penetrating the pole 10, it is contemplated that the gripping could occur without penetration. FIG. 5 shows the gripper plates of the opposed cage portions 18*a* in full gripping position.

It should be understood that the elongate cage portions 18*a* are, also, at their upper ends, secured to the pole 10 by means of a bolt 28 passing through an opening 29 drilled through pole 10, bolt 28 being secured in place by a nut 30. The upper end portions of preferably galvanized steel cage parts 18*a* will also preferably be secured in place by pairs of steel bands 31 and 32. The bands 31 and 32 may each have one end nailed to post 10 and the opposite end wrapped around members 18*a* and pole 10 once or twice to a position of overlap in which the overlapped portions are gripped and rigidly secured by U-shaped pairs of crimpable steel plates 33. A suitable crimping tool is used to crimp the embracing plates 33 and bands 31 and 32, as shown, to secure them in embracing position.

THE OPERATION

Figure 2:
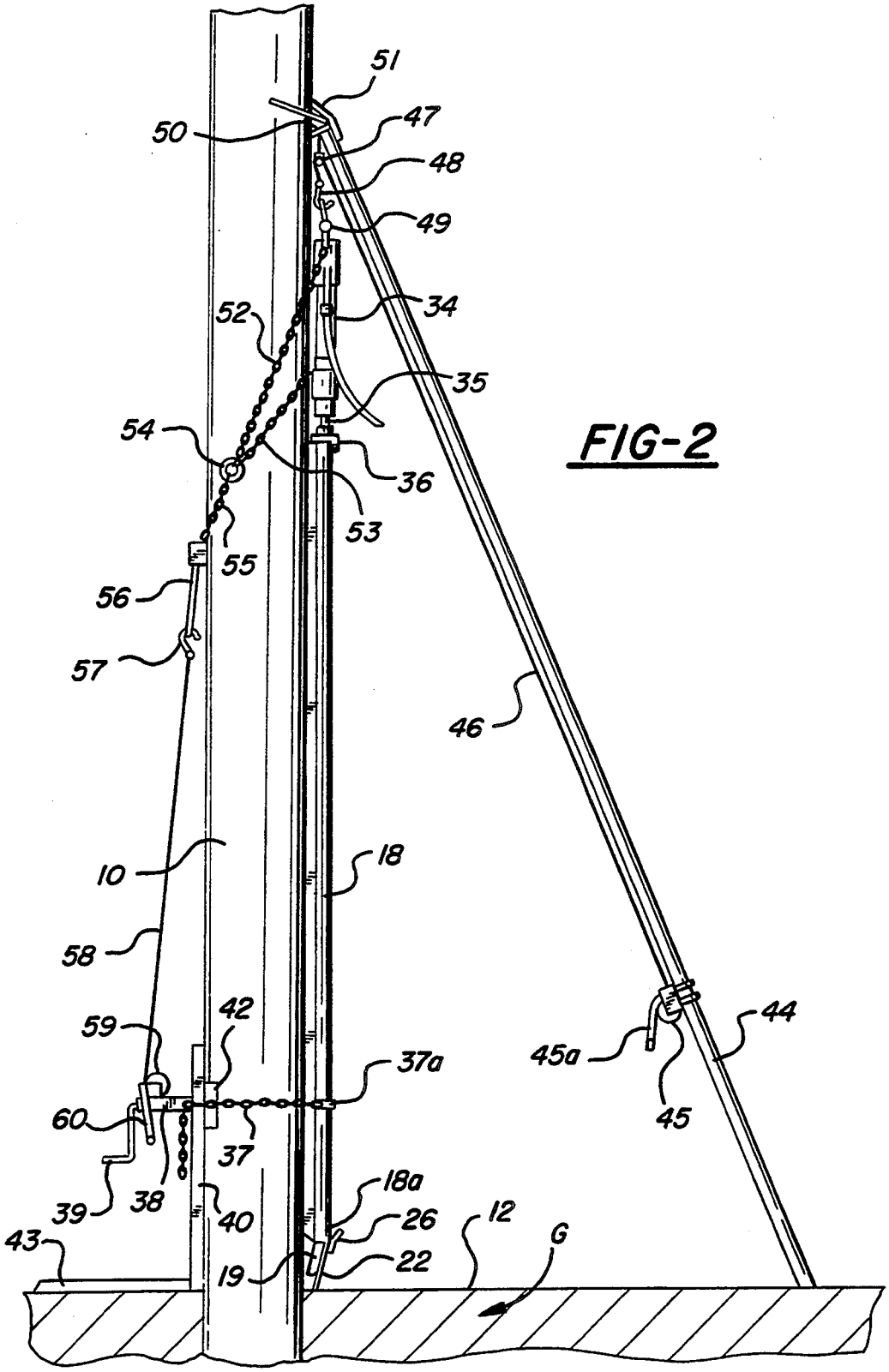
FIG. 2 is a side elevational view illustrating a cage part, which is constructed in accordance with the invention, disposed in position to be driven down alongside the portion of a utility pole which is embedded in the ground.

As shown in FIG. 2, the cage parts 18*a* may be driven into place by a jackhammer 34, powered hydraulically or with air under pressure, to strike repetitive blows on the upper edge of a cage part 18*a*. The jackhammer has the usual piston rod 35, with a fitting 36 for engaging the upper end of cage portion 18. In driving position, the gripper plate 22 has its upper edge 28 in load-bearing engagement with the plate 18*a* so that blows directed to cage portion 18*a* are delivered directly to plate 22, without imposing a load on pivot bolt 24. Each elongate cage part 18*a* is initially chained in position, as with a chain 37 mounting rollers 37*a* which engage and protect the member 18*a*, the chain 37 which embraces the member 18*a* and pole 10 being tightened by a screw-operated tightener 38, actuated by a handle 39. The device 38 is supported on an upright member 40 having an arcuate bearing plate 42 to engage the pole 10, and support 41 has a support plate 43 on which a workman can stand while tightening the chain 37.

The jackhammer 34 may be supported by a pole 44 mounting a reel 45 on which is wound a steel or other suitable cable 46 which is trained around a pulley 47 secured on the upper end of pole 44. Handle 45*a* is connected to operate reel 45. Cable 46 terminates in a hook 48 which captures a support ring 49 secured to the upper end of the jackhammer 34. At its upper end pole 44 mount the pole engaging plate 50 and a U-shaped element 51 for also embracing and engaging pole 10 in tripod fashion.

Chains 52 and 53, connected to the jackhammer 34 at opposite ends as shown, both connect to a ring 54 which has a chain connection 55 to a bale member 56. Member 56 is captured by a hook 57, connected to a steel or other suitable cable 58 wound on a reel 59 which can be operated by a handle 60. As the repeated blows of jackhammer 34 drive the cage portion 18*a* downwardly, handles 45*a* and 60 are operated to respectively relieve and pull downwardly on the jackhammer 34 so that it follows the cage portion 18*a* downwardly. The position of the plate 22, when being driven, is angled vertically inwardly slightly so that it tends to force the cage part 18*a* to hug the pole as it is driven into the ground. When both cage portions 18*a* are driven down to the FIG. 3 position, which is a position some inches below the position in which gripping occurs, the cage portions 18*a* are lifted upwardly a distance of, typically, twelve inches. As mentioned earlier, this lifting of elements 18*a* results in earth pressure on the cam members 26, causing them to pivot outwardly away from the cage parts 18*a*, with bolts 24 moving in the slots 21*a* initially to free the surfaces 27. The cage portions 18*a* may be lifted simultaneously in any suitable manner, as with vehicle mounted clamps on a boom or lift platform, which grip the upper ends of the parts 18*a*, the shape of cage parts 18*a* being such as to facilitate this, as shown in FIG. 10. The successive positions of gripper plates 22 are illustrated in FIGS. 3–5 and 6–9. Once the gripper plates 22 are in the position shown in FIG. 5, bolt 28 and bands 31 may be affixed.

Figure 11:
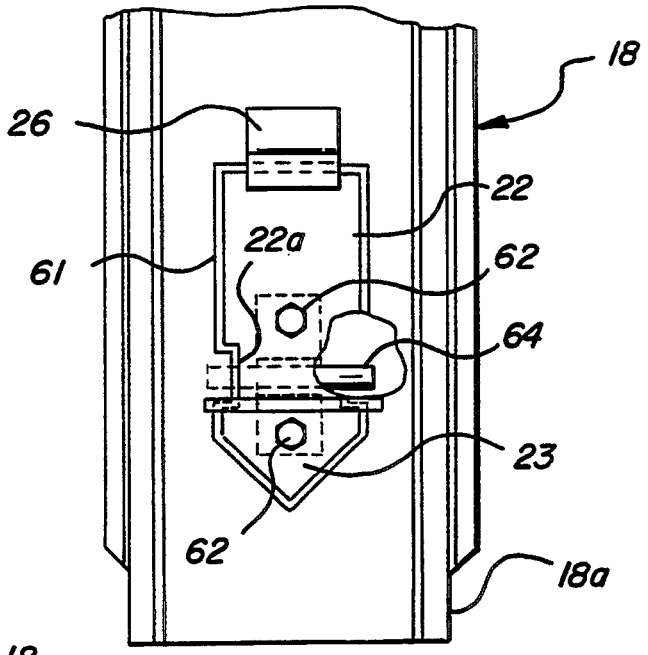
FIG. 11 is a fragmentary, front elevational view illustrating a modified embodiment of the invention which is useful particularly in very rocky soil.
Figure 12:
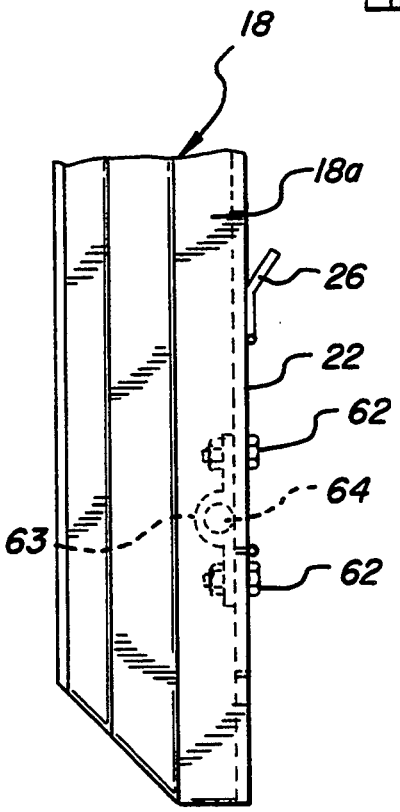
FIG. 12 is an end elevational view thereof.

In FIGS. 11–13 another embodiment of the invention is illustrated in which the gripper plates 22 are pivotally mounted on the lower end of the cage portions 18*a* at a spaced distance above the lower ends of the columns 18*a* of the cage portions 18. For purposes of convenience, the same numerals have been used to identify like elements in FIGS. 11–13 where possible. As FIG. 11 indicates, each gripper plate 22 has the same convergent configuration 23 at its one end and the same cam plate 26 at its opposite end.

Intermediate its ends, the plate 22 is notched as at 22*a*. As FIGS. 11 and 12 particularly indicate, each channel member 18*a* is cut away above its lower end as at 61 to accommodate the configuration of a gripper plate 22, with cam members 26 protruding above the cutout portions 61 when the gripper plates 22 are in the vertical position shown in FIG. 12. Fixed to the interior side of each gripper plate 22, as with bolt and nut assemblies 62, is a bearing plate 63 which accommodates a fixed pin 64 having its outer ends welded or otherwise suitably fixed to the interior wall of the channel 18*a*. The gripper plate 22 for each of the channels 18*a* is pivotable about one of the pins 64 from the vertical position shown in FIG. 12 to the pole engaging and gripping position shown in FIG. 13.

In this embodiment which is particularly useful when the ground is rocky so that penetration is more difficult, the channels 18*a* are first of all driven into the ground to the required depth by the jackhammer structure 34 previously described. Once this depth is reached, then again, by moving the channels 18*a* upwardly, the cam plates 26 cause the gripper plates 22 to move from the FIG. 12 to the FIG. 13 position to grip the pole. Otherwise the structure and operation previously described is identical. The upper end of the cage structure is secured in the manner illustrated in FIG. 5. The purpose of the construction illustrated in FIGS. 11–13 is to provide an alternative in which the grippers 22 are not directly driven into the ground.

The system described solves the problems presented by uplift and thrust stresses, as well as bending stresses, and provides a unitary structure which grips the pole at its lower end as well as at a distance above ground level. Even when the pole at the ground line is almost totally decayed, the old pole can still be restored for a fraction of the cost of replacement. In most cases, the reinforcement system disclosed can add upwards of twenty years of additional life to existing poles and typically, a trained crew can install the system in less than an hour. Because the various metal parts of the system are fabricated from galvanized steel, the system will not rust out.

It is to be understood that the embodiments described are exemplary of various forms of the invention only and that the invention is defined in the appended claims which contemplate various modifications within the spirit and scope of the invention.

I claim:

1. A method of reinforcing wooden utility and like poles, having lower ends embedded sufficiently deeply in the ground to normally support them in fixed position when first installed, with elongate reinforcement cages having portions with grippers at their lower ends which are swingably secured to the cage portions, for movement from a first position in which said grippers form rigid extensions of said cage portions and can be driven into the earth with said cage portions to a position alongside said pole in which said grippers are beneath weak portions of said pole adjacent groundline, to a second position in which said grippers are swung to substantially grip said pole between them, comprising:

(a) forcing said cage portions down along said pole with said grippers disposed in said first position; and (b) lifting said cage portions and causing the pressure of the earth to swing said grippers to second position, and then securing said cage portions to said pole above ground to form a unitary cage structure embracing said pole.

2. The method of claim 1 wherein said cage portions are secured by banding them rigidly together with metal band mechanism embracing said pole.

3. The method of claim 1 wherein pairs of steel bands in spaced apart relation are secured to unite said cage portions.

4. The method of claim 1 wherein said cage portions are bolted to said pole near the upper ends of said cage portions, after said grippers reach second position.

5. The method of claim 1 wherein said grippers are swung sufficiently to engage and penetrate said pole when swung to second position by the pressure of the earth.

6. The method of claim 2 wherein a cross bolt extending through said cage portions is secured to fix said cage portions to said pole above ground, after said grippers reach second position.

7. The method of claim 1 comprising reinforcing a pair of connected utility poles wherein one of the poles is the pole defined in claim 1 by:

(a) forcing further such cage portions down alongside the other of said connected poles, with all said cage portions of both poles generally in a plane of alignment corresponding to the general plane of connection;

(b) lifting said further cage portions driven alongside said other pole to swing the grippers attached thereto into said pole via the pressure of the earth;

(c) and securing said further cage portions to said other pole above ground to form a unitary cage structure embracing said other pole.

8. The method of claim 1 wherein the swing of said grippers to second position is positively stopped by the pole after a predetermined degree of swing has occurred and said grippers have reached a substantially horizontal position in which the pressure of the earth thereon best resists uplift forces.

9. A cage structure for reinforcing utility and like poles having lower ends embedded in the ground which may have weakened areas adjacent the ground line, or require the reinforcement because of the imposition of stresses including:

(a) a pair of rigid cage portions for embracing the pole; and (b) a gripper supported by the lower end of each cage portion and having a lower end generally configured to facilitate driving it into the ground; and (c) means connected to each cage portion for supporting each gripper for swinging movement therefrom for movement from a first position in driving alignment with each said cage portion to a gripping position; and (d) cam means on said grippers for swinging said grippers in to said pole due to the pressure of the earth thereon when said cage portions are pulled upwardly to a limited extent.

10. The cage structure of claim 9 which includes mechanism for rigidly connecting the cage portions to the pole above ground.

11. The cage structure of claim 9 wherein said means swingably supporting each gripper comprises pivot means connecting through elongate slots with said grippers to provide relative vertical movement between said cage portions and grippers.

12. The cage structure of claim 9 wherein said grippers have load bearing surfaces which, in said first position, are vertically engaged with said cage portions to prevent imposition of undue load on said pivot means.

13. The cage structure of claim 12 wherein said grippers have convergent end portions at one end which are inclined downwardly and inwardly when said grippers are in said first position with the load bearing surfaces engaged in vertical alignment with said cage portions.

14. The cage structure of claim 13 wherein said grippers are plate members pivotally connected to said cage portions by said pivot means interjacent their ends, and said cam means comprises a plate secured to the end of each gripper opposite its said convergent end portion and adjacent said load bearing surfaces so as to be upwardly and outwardly inclined with respect to said gripper plates when the grippers are in said first position.

15. The cage structure of claim 14 in which said gripper plates have attachment brackets with elongate slots through which said pivot means extend, said pivot means being carried by said cage portions and movable in said slots to permit the gripper plates to swing out from first position to second position when the cage portions are moved upwardly.

16. The cage structure of claim 9 wherein a bolt connects the upper ends of said cage portions.

17. The cage structure of claim 16 wherein bands embracing said cage portions connect the upper ends of said cage portions.

18. A cage part for reinforcing utility and like poles having lower ends embedded in the ground which may have weak areas adjacent the ground line, or require the reinforcement because of the imposition of stresses, comprising:

(a) a rigid cage portion;

(b) a gripper connected to the lower end of the cage portion and having a lower end generally configured to facilitate driving it into the ground;

(c) means connected to the cage portion for supporting the gripper for swinging movement from a first position in driving alignment with said cage portion to a gripping position; and (d) cam means on the gripper for swinging said gripper in to said pole due to the pressure of the earth thereon when the cage portion is pulled upwardly to a limited extent.

19. The cage part of claim 9 wherein said means swingably supporting each gripper comprises pivot means connecting through an elongate slot with said gripper to provide relative vertical movement between said cage portion and gripper.

20. The cage structure of claim 19 wherein said gripper has a load bearing surface which, in said first position, is vertically engaged with said cage portion to prevent imposition of undue load on said pivot means.

21. The cage structure of claim 20 wherein the gripper is a plate member pivotally connected to said cage portion by said pivot means interjacent its ends, and said cam means comprises an outwardly inclined plate secured to the end of said gripper opposite its said lower end and adjacent said load bearing surface so as to be upwardly and outwardly inclined with respect to said gripper plate when the gripper is in said first position.

22. The cage structure of claim 21 in which said gripper plate has an attachment bracket with an elongate slot through which said pivot means extends, said pivot means being carried by said cage portion and movable in said slot to permit the gripper plate to swing out from first position to second position when the cage portion is moved upwardly.

23. A method of reinforcing wooden utility and like poles, having lower ends embedded sufficiently deeply in the ground to normally support them in fixed position when first installed, with elongate reinforcement cages having portions with grippers at their lower ends which are swingably secured to the cage portions, for movement from a first position in which said grippers can be moved into the earth with said cage portions to a position alongside said pole in which said grippers are beneath weak portions of said pole adjacent groundline, to a second position in which said grippers are swung to substantially grip said pole between them below groundline, comprising:

(a) forcing said cage portions down along said pole with said grippers disposed in said first position; and (b) lifting said cage portions and causing the pressure of the earth to swing said grippers to second position, and then securing said cage portions to said pole above ground to form a unitary cage structure embracing said pole.

24. The method of claim 23 wherein said cage portions are secured by banding them together with band mechanism embracing said pole.

25. The method of claim 23 wherein pairs of steel bands in spaced apart relation are secured to unite said cage portions.

26. The method of claim 23 wherein said cage portions are bolted to said pole near the upper ends of said cage portions, after said grippers reach second position.

27. The method of claim 23 comprising reinforcing a pair of connected utility poles wherein one of the poles is the pole defined in claim 23 by:

(a) forcing further such cage portions down alongside the other of said connected poles, with all said cage portions of both poles generally in a plane of alignment corresponding to the general plane of connection;

(b) lifting said further cage portions driven alongside said other pole to swing the grippers attached thereto in to said pole via the pressure of the earth;

(c) and securing said further cage portions to said other pole above ground to form a unitary cage structure embracing said other pole.

28. A cage structure for reinforcing utility and like poles having lower ends embedded in the ground which may have weakened areas adjacent the ground line, or require the reinforcement because of the imposition of stresses including:

(a) a pair of rigid cage portions for embracing the pole; and (b) a gripper supported by the lower end of each cage portion; and (c) means connected to each cage portion for supporting each gripper for swinging movement relative to said cage portion for movement from a first position generally in alignment with each said cage portion to a gripping position; and (d) cam means on said grippers for swinging said grippers in to said pole due to the pressure of the earth thereon when said cage portions are pulled upwardly to a limited extent.

29. The cage structure of claim 28 wherein said grippers are pivotally connected to said cage portions interjacent their ends, and said cam means comprises a cam surface secured to each gripper so as to be inclined with respect to said grippers when the grippers are in said first position.

30. A cage part for reinforcing utility and like poles having lower ends embedded in the ground which may have weak areas adjacent the ground line, or require the reinforcement because of the imposition of stresses, comprising:

(a) a rigid cage portion;

(b) a gripper supported by the lower end of the cage portion;

(c) means connected to the cage portion for supporting the gripper for swinging movement from a first position generally in alignment with said cage portion to a gripping position; and (d) cam means on the gripper for swinging said gripper in to said pole due to the pressure of the earth thereon when the cage portion is pulled upwardly to a limited extent.

31. The cage structure of claim 30 wherein the gripper is pivotally connected to said cage interjacent its ends, and said cam means comprises a cam member secured to said gripper so as to be inclined with respect to said gripper when the gripper is in said first position.

32. The invention disclosed in claim 30 wherein said cage part is recessed at a spaced distance above its lower end to receive and pivotally mount said gripper.

* * * * *